US006157011A

United States Patent [19]

Lai

[11] Patent Number: 6,157,011

[45] Date of Patent: Dec. 5, 2000

[54] ELECTROMAGNETIC STOVE STRUCTURE

[76] Inventor: Hui-Wen Lai, 10F-4, No. 36, Lane 355, Chung Hwa Rd., Yung Kang Shiang, Tainan Hsien, Taiwan

[21] Appl. No.: 09/573,665

[22] Filed: May 19, 2000

[51] Int. Cl.[7] ..... H05B 6/12

[52] U.S. Cl. ..... 219/622; 219/621; 219/624; 219/434; 126/275 E; 99/451; 99/DIG. 14

[58] Field of Search ..... 219/622, 623, 219/624, 621, 620, 429, 430, 433, 434; 126/217, 218, 275 E; 99/451, DIG. 14

[56] References Cited

U.S. PATENT DOCUMENTS 5,032,699 7/1991 Hu ..... 219/622

FOREIGN PATENT DOCUMENTS 52-70444 6/1977 Japan ..... 219/624

5-226069 9/1993 Japan ..... 219/624

5-343172 12/1993 Japan ..... 219/622

*Primary Examiner*—Philip H. Leung

*Attorney, Agent, or Firm*—Rosenberg Klein & Lee

[57] ABSTRACT

An electromagnetic stove structure, particularly an electromagnetic stove having a face panel on which an independent type heating plate that can be separated from the electromagnetic stove is disposed. The bottom portion of the heating plate is provided with a protective hood accommodating induction coils, a temperature sensor and iron powder cores. The electromagnetic stove has disposed thereon a positioning post that can be adjusted to extend or retract and to rotate and that is connected to a securing frame on a pot. The heating plate can be removed together with the pot by means of electromagnets adhering to the bottom side of the pot. The pot can swing about a suitable angle by using the positioning post as center of rotation, and can be in contact with the heating pot all the time to be heated thereby.

4 Claims, 8 Drawing Sheets

ELECTROMAGNETIC STOVE STRUCTURE

BACKGROUND OF THE INVENTION (a) Field of the Invention

The present invention relates to an electromagnetic stove structure, and more particularly to a pot that can be heated by the electromagnetic stove all the way and can be shaken on the electromagnetic stove by the user during stirfrying.

(b) Description of the Prior Art

A conventional electromagnetic stove structure includes a planar face panel for placement of a pot thereon for heating and cooking food by means of the electromagnetic action of the electromagnetic stove. In general, the conventional electromagnetic stove is used for making hot pots or boiling water. Seldom do people use it for stir-frying. This is mainly due to the fact that the electromagnetic stove utilizes electromagnetic action to heat the food in the pot indirectly. Once the pot leaves the electromagnetic stove, the induction coil and electromagnetic heating unit inside the electromagnetic stove cannot heat the pot, resulting in temporary cooling off of the food in the pot, and making it difficult to control the time of heating of the food inside the pot. If the pot is placed flatly on the electromagnetic stove to be shaken horizontally, although it can be subjected to the electromagnetic action and heated, the electromagnetic field generated by the induction coil may become unstable due to displacement of the pot, resulting in reduced service life of the electromagnetic stove.

SUMMARY OF THE INVENTION

The object of the present invention is to provide an electromagnetic stove structure, in which the electromagnetic stove has a face panel on which is disposed an independent type heating plate that can be separated from the electromagnetic stove. The bottom portion of the heating plate is provided with a protective hood accommodating induction coils and a temperature controlling element. The heating plate has a surface provided with electromagnets. A height adjustable and rotatable positioning post is provided at one side of the electromagnetic stove to be connected to a securing frame fixedly provided at the edge of the pot. The securing frame is connectedly provided at the edge of the pot for holding the pot to enable the pot to swing about a suitable angle by utilizing the securing frame with the positioning post as center of rotation. By mean of electromagnets on the bottom side of the heating plate to adhere to the pot, the pot can be in contact with the heating plate to be heated thereby all the time under the premise of not damaging the original structure of the pot, thereby complying with the user's habit to shake the pot.

DETAILED DESCRIPTION OF THE PREFERRED EMBODIMENT

Figure 1:
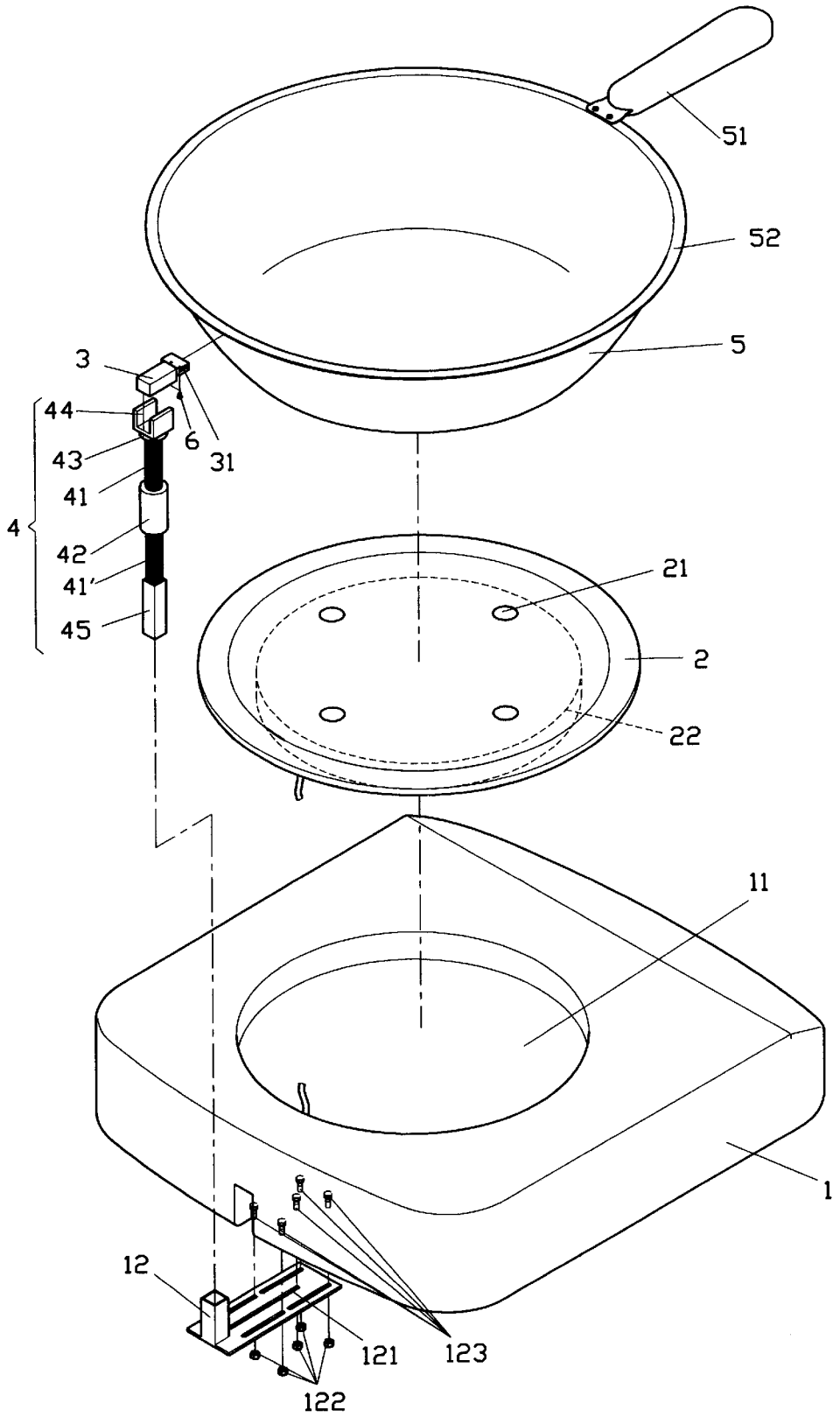
FIG. 1 is an exploded perspective view of the present invention.
Figure 2:
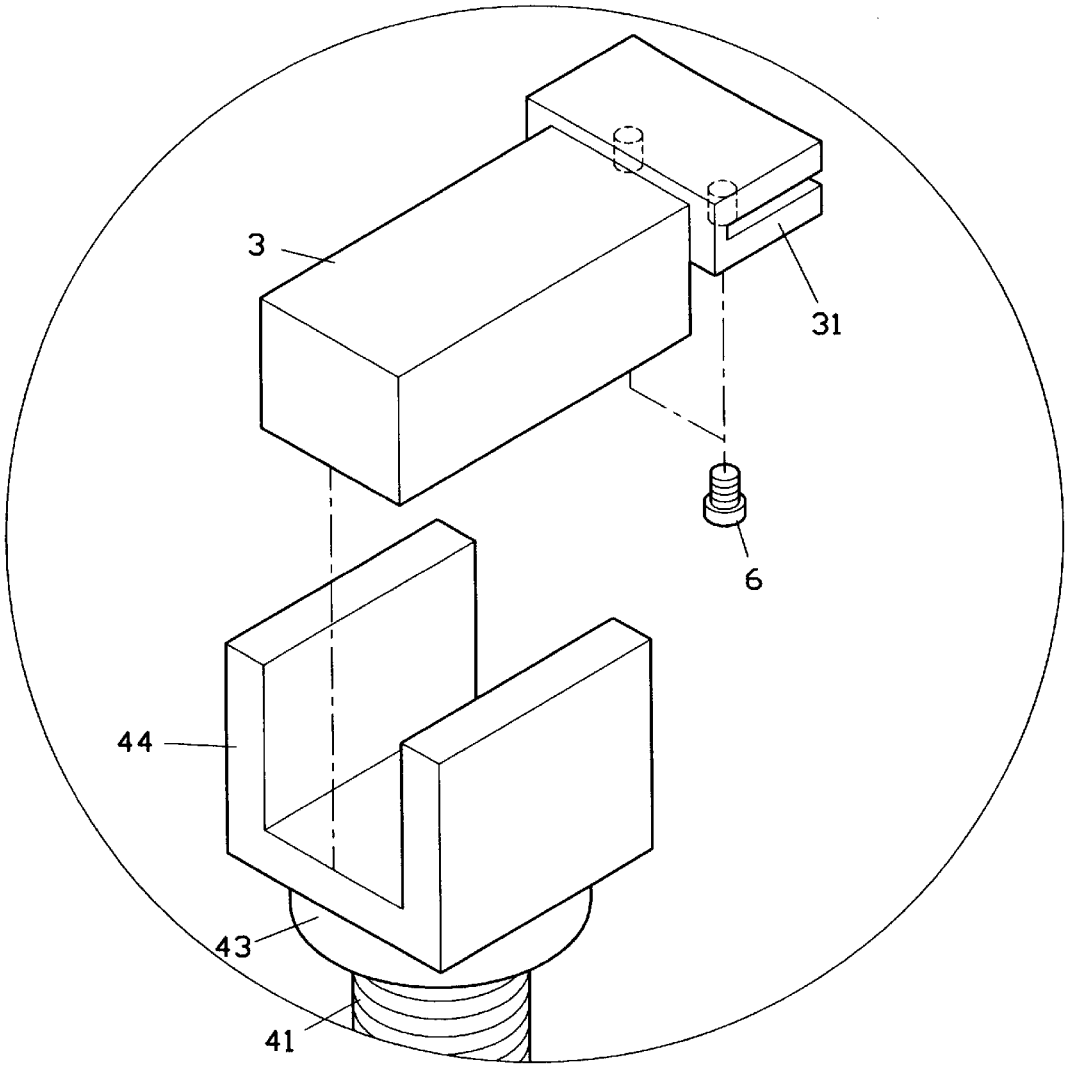
FIG. 2 is a partly enlarged view of FIG. 1.

With reference to FIGS. 1 and 2, the present invention includes an electromagnetic stove 1, a heating plate 2, a securing frame 3, and a positioning post 4, as well as a pot 5 adapted for use therewith.

The electromagnetic stove 1 is internally provided with a plurality of control elements and has a face panel formed with a receiving recess 11 for receiving the heating plate 2. A coupling seat 12 is locked to the bottom portion of the electromagnetic stove 1 by means of threaded connecting elements 122, 123. The surface of the coupling seat 12 is provided with a plurality of slide tracks 121 for slidable displacement relative to the electromagnetic stove 1.

The heating plate 2 is formed to be a concave independent type plate. The surface thereof is provided with a plurality of electromagnets 21 (see FIG. 3). The outer periphery of the electromagnet is provided with induction coils 211. The bottom portion of the electromagnet 21 is formed to have a threaded section 212 for receiving a nut 213. The bottom edge of the plate 2 is provided with a protective hood 22. The protective hood 22 has disposed therein induction coils 221, a temperature sensor 222, and iron powder cores 223. The electromagnets 21 and the induction coils 221 are isolated from each other by isolation hoods 224 so as to prevent interference and to enable the power cord to be connected to the electromagnetic stove 1 to be controlled and actuated thereby.

One end of the securing frame 3 is formed to be a clamping plate 31 for claiming the edge of the pot 5. The clamping plate 31 may be formed to have a U-shaped cross-section matching the thickness of the pot 5 so as to clamp the pot 5.

The positioning post 4 is comprised of two threaded rods 41, 41' having left and right threads, and an internally threaded coupling ring 42 interconnecting them. The top portion of the threaded rod 41 is provided with a bearing 43 and a U-shaped securing seat 44. The bottom portion of the threaded rod 41' is provided with an angular seat 45 for insertion into the coupling seat 12 so as to abut against the floor (or table surface). The height of the positioning post 4 is adjustable by turning the coupling ring 42 to adjust the distance between the two threaded rods 41, 41'.

The pot 5 has a handle 51 extending from the edge, which forms a raised wall 52.

During assembly, as shown in FIG. 2, the angular seat 45 at the bottom portion of the positioning post 4 is first vertically inserted into the coupling seat 12 of the bottom portion of the electromagnetic stove 1 to abut against the table surface to be positioned. The protective hood 22 of the bottom portion of the heating plate 2 is placed flatly in the receiving recess 11 of the electromagnetic stove 1. The clamping plate 31 of the securing plate 3 clamps the raised wall 52 of the pot 5, with threaded connecting elements 6 passing through the clamping plate 31 to abut against the side of the pot 5 to thereby secure the pot 5 without damaging the original structure of the pot 5. The other end of the securing frame 3 extends into the securing seat 44 of the positioning seat 4 to support the pot 5 to thereby form a supporting point.

Figure 3:
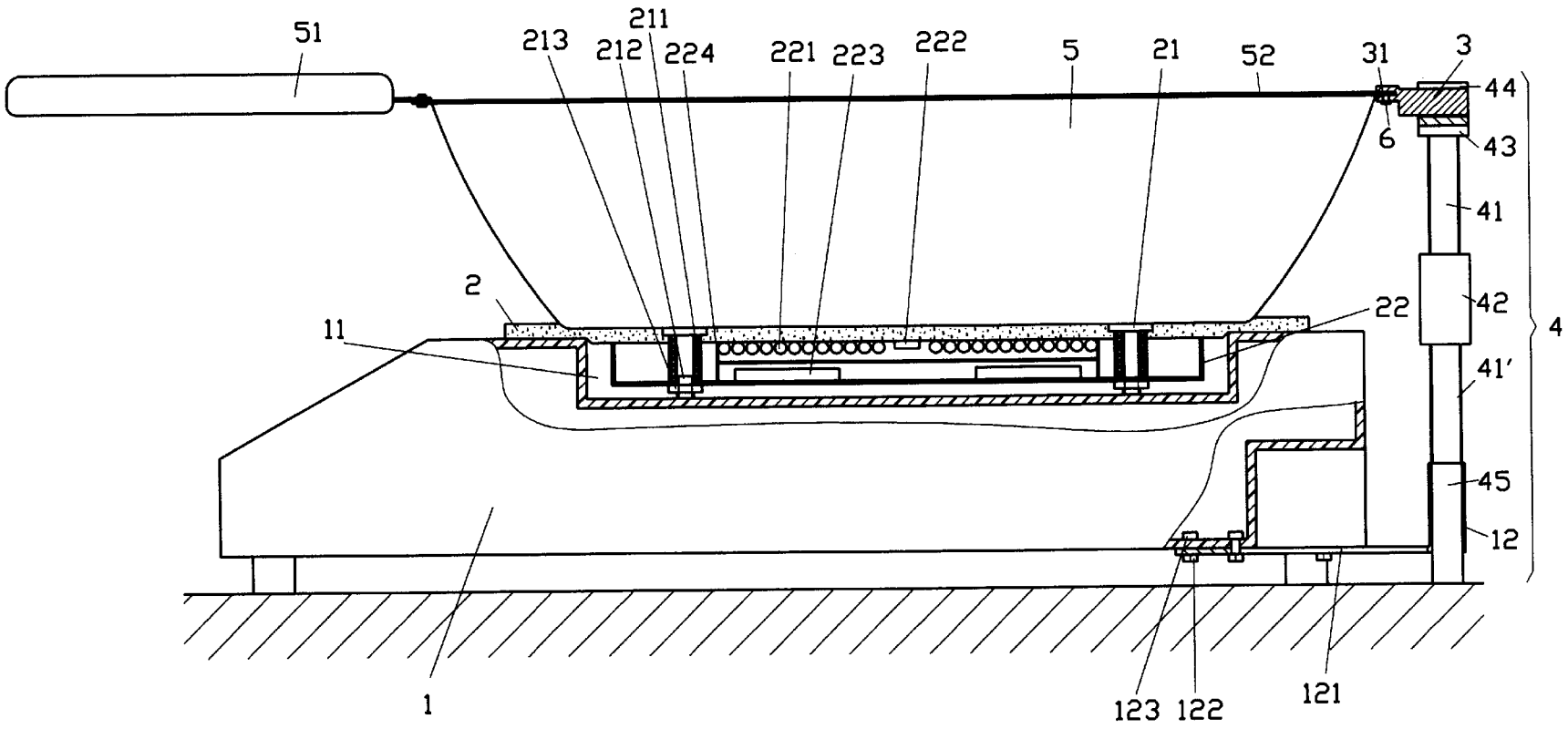
FIG. 3is an assembled sectional view of the present invention.
Figure 4:
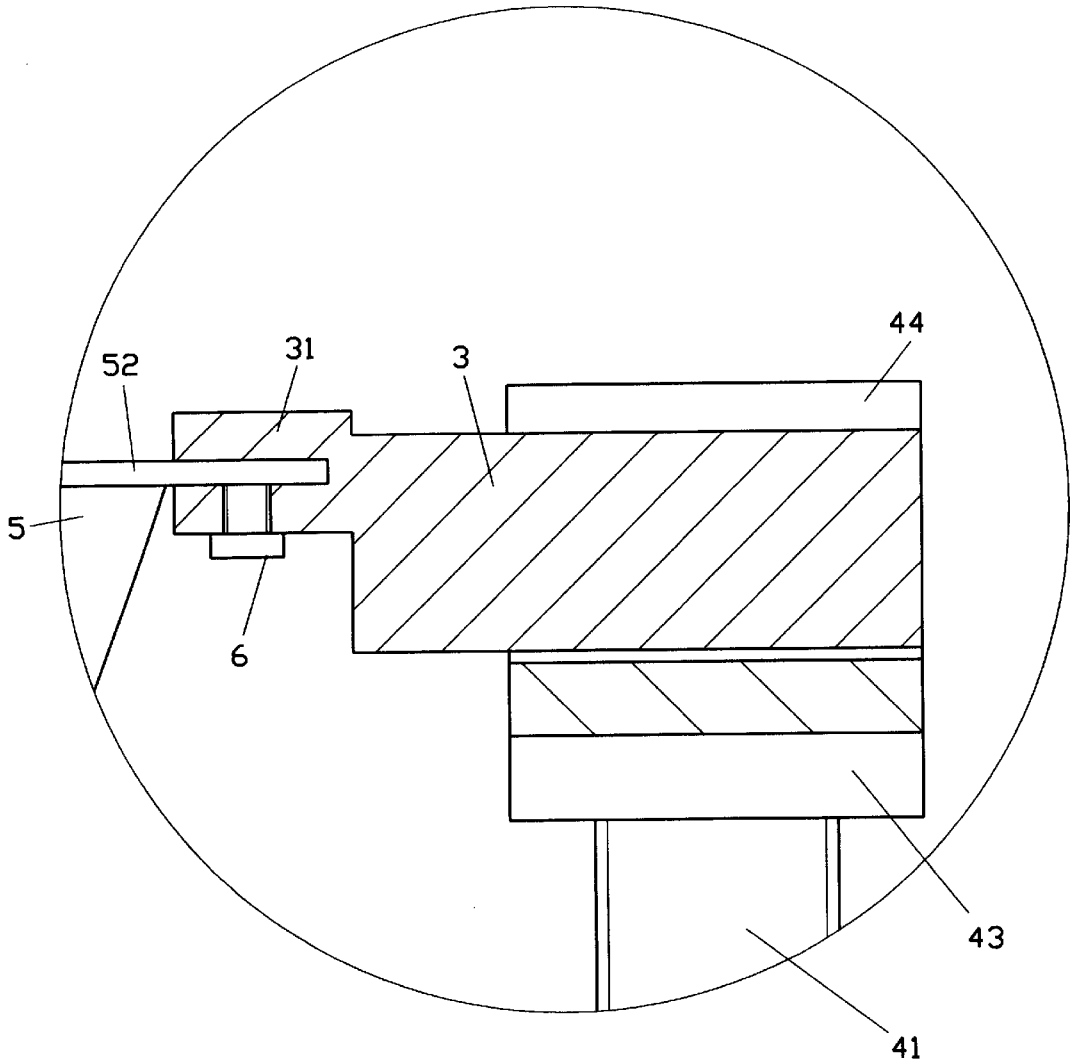
FIG. 4 is a partly enlarged view of FIG. 3.
Figure 5:
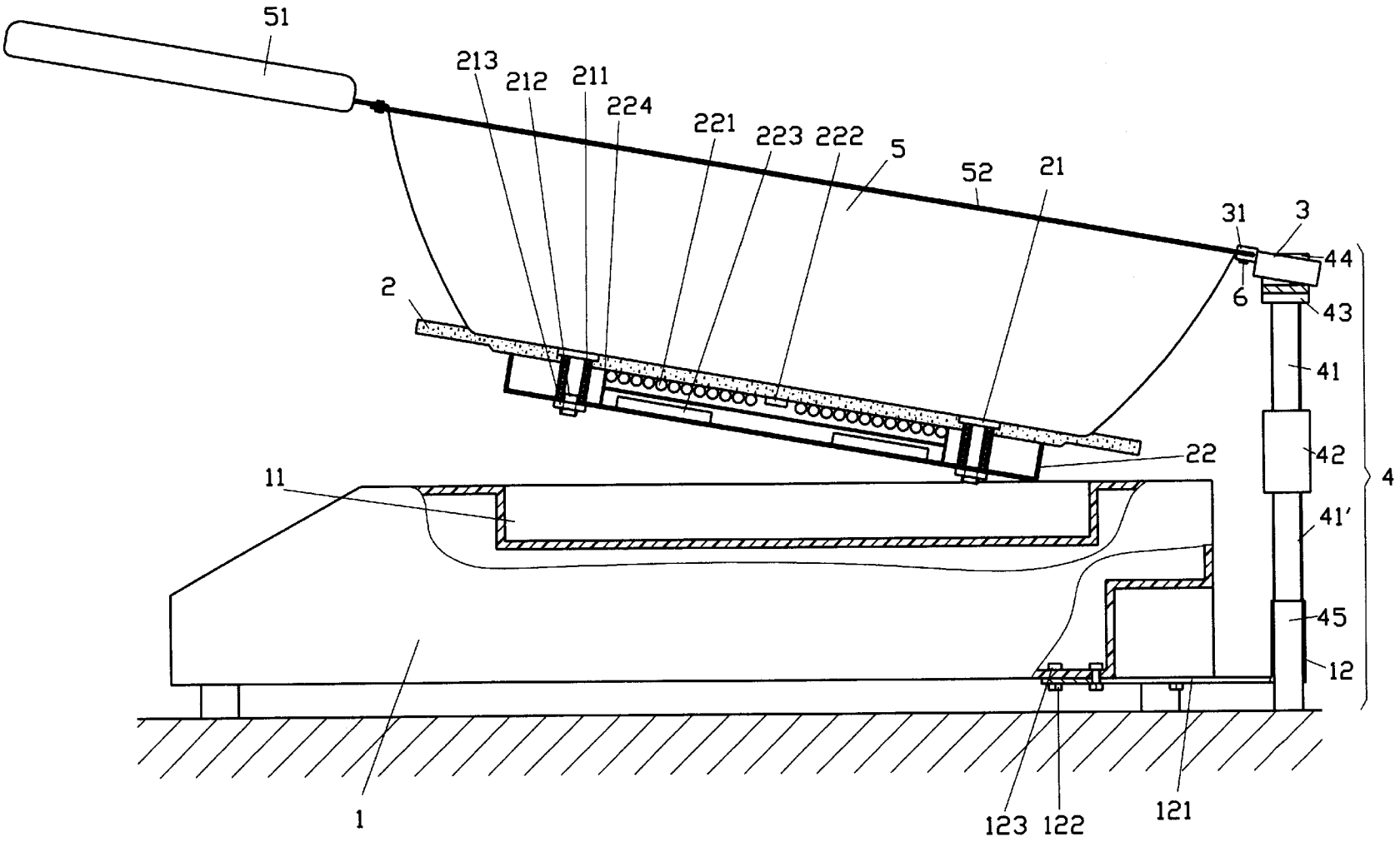
FIG. 5 is a schematic view illustrating upward and downward swinging of the present invention.
Figure 6:
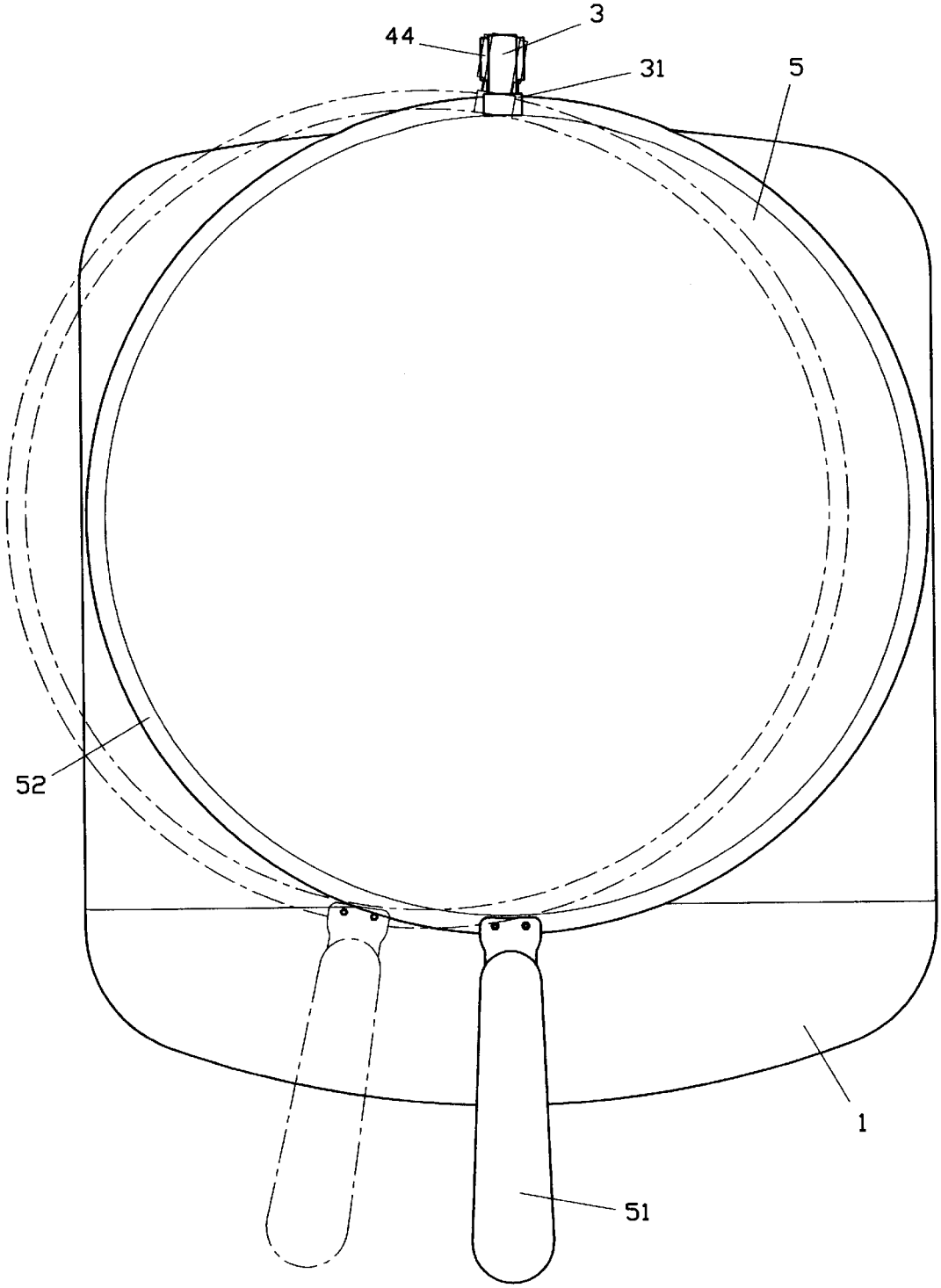
FIG. 6 is a schematic view illustrating sidewise swinging of the present invention.

In practice, as shown in FIGS. 3, 4 and 5, the electromagnets 21 on the heating plate 2 abut against the bottom side of the pot 5 upon electrical connection, so that the pot 5 and the heating plate 2 can be connected integrally. The pot 5 can be held by the handle 51. Since the heating plate 2 can adhere to the bottom portion of the pot 5 by means of the electromagnets 21, when the pot 5 is lifted, the heating plate 2 on the bottom side thereof is also removed from the electromagnetic stove 1 together therewith. Hence, the pot 5 is all the time in contact with the heating plate 2 to be heated thereby. Besides, by means of the supporting point formed by the securing frame 3 and the positioning seat 44, the pot 5 can swing upwardly and downwardly relative to the positioning post 4. And by means of the bearing 43 at the bottom portion of the securing seat 44, the pot 5 can be turned sidewise, as shown in FIG. 5, so as to match people's habit to move the pot 5 during stir-frying.

Figure 7:
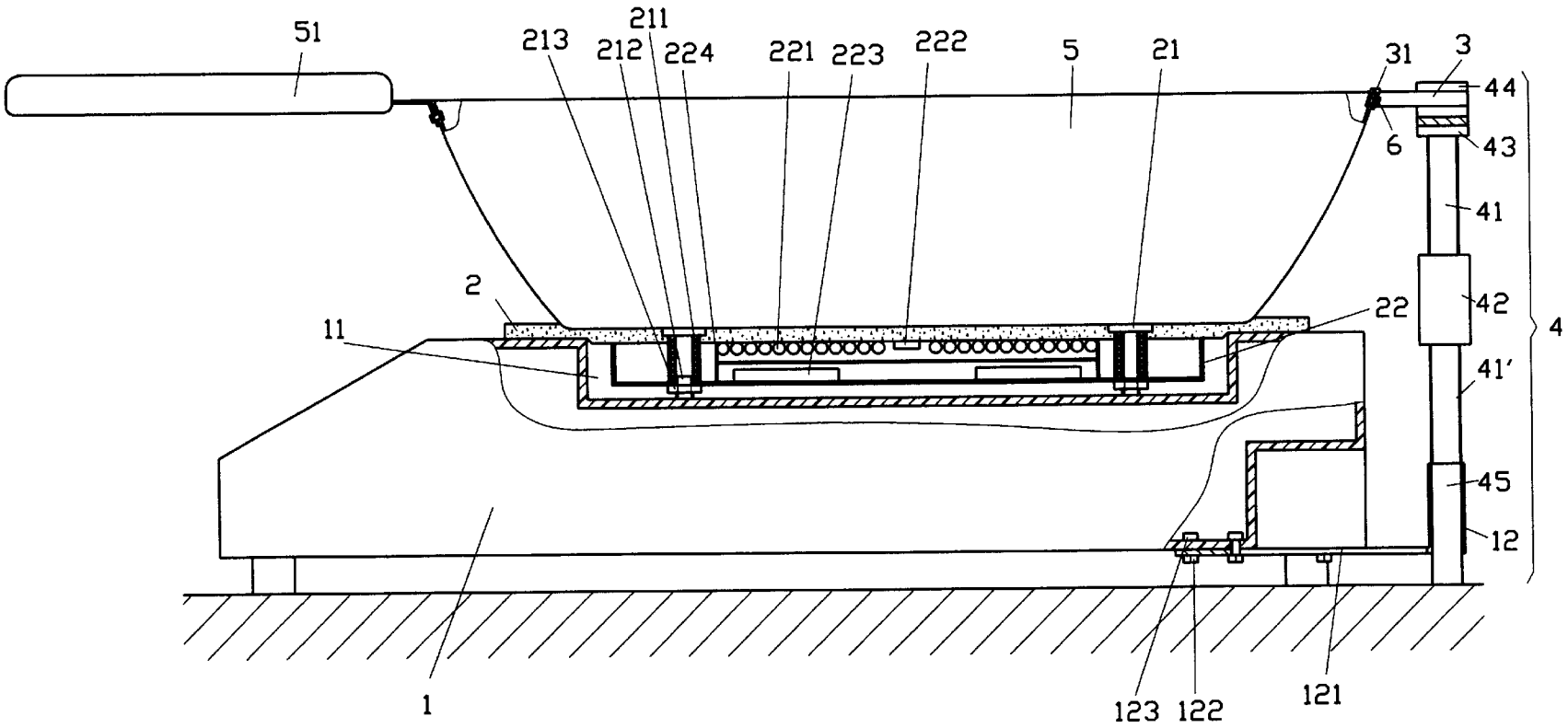
FIG. 7 illustrates another embodiment of the present invention.
Figure 8:
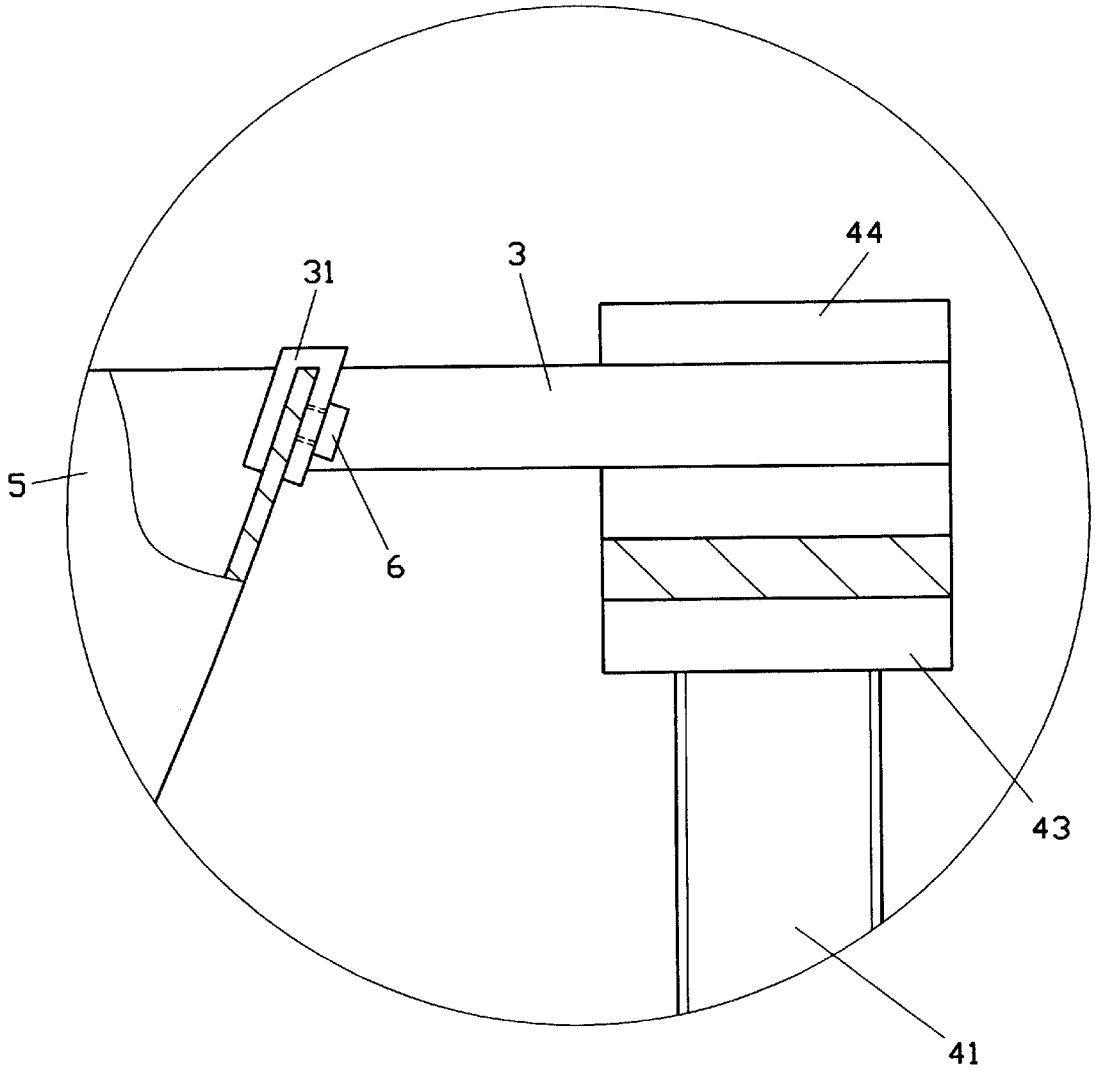
FIG. 8 is a partly enlarged view of FIG. 7.

Furthermore, the present invention can also be used with a pot 5 without the raised wall 52. As shown in FIGS. 7 and 8, the clamping plate 31 at the front end of the securing frame 3 is bent downwardly to form a seat along the pot 5. By using the clamping plate 31 to clamp the edge of the pot 5 with a threaded element 6 abutting the edge of the pot 5. The pot 5 can be placed on the electromagnetic stove 1 in the same manner as in the previous embodiment to permit the user to shake the pot 5 for stirring the cooked food of the pot 5.

Further, if the present invention is employed to boil water or in a situation where shaking of the pot 5 is not necessary, the pot 5 can be placed on the heating plate 2 with the electromagnets 21 at the bottom portion of the heating plate 2 adhering to the bottom portion of the pot 5 so that the pot 5 can be placed stably on the electromagnetic stove 1 to achieve a positioning effect compared to conventional electromagnetic stoves 1.

What is claimed is:

1. An electromagnetic stove structure, comprising a electromagnetic stove, a heating plate, a securing frame, and a pot for use therewith, the pot having an edge extending to form a handle, wherein:

the electromagnetic stove has a face panel on which is disposed said heating plate that is of an independent type and that can be separated from said electromagnetic stove, the bottom portion of said heating plate being provided with a protective hood accommodating induction coils and a temperature controlling element, said heating plate having a surface provided with electromagnets, an adjustable and rotatable positioning post being provided on said electromagnetic stove to be connected to said securing frame that is secured to the edge of the pot;

said securing frame has one end forming a clamping plate for holding the pot;

by connecting said securing frame holding the pot to said positioning post of said electromagnetic stove, said securing frame can clamp the pot and swing about a suitable angle with said positioning post as center of rotation, and by means of said electromagnets of said heating plate adhering the pot, the pot can be in contact with said heating plate all the time to be heated thereby.

2. The electromagnetic stove structure of claim 1, wherein said electromagnetic stove is provided with a coupling seat capable of adjusting slidable displacement for insertable connection with said positioning post, said positioning post including two threaded rods respectively having left and right threads and connected by a coupling ring, the top portion of said threaded rods being connected to a securing seat and a bearing for connection with said securing plate of the pot, whereby rotation of said coupling ring can turn one of said threaded rods to thereby permit said positioning post to extend or retract.

3. The electromagnetic stove structure of claim 2, wherein said coupling seat being formed to be a polygonal hollow seat, the bottom portion of said threaded rods of said positioning seat being formed to be angular seats matching the shape of said coupling seat.

4. The electromagnetic stove structure of claim 1, wherein said clamping plate at the end portion of said securing frame being bent downwardly along the edge of the pot to be secured to the edge of the pot by means of a threaded element.

* * * * *